US006123058A

United States Patent [19]

Endou

[11] Patent Number: 6,123,058

[45] Date of Patent: Sep. 26, 2000

[54] INJECTOR DRIVE CIRCUIT

[75] Inventor: Tsuneaki Endou, Numazu, Japan

[73] Assignee: Kokusan Denki Co., Ltd., Shizuoak-Ken, Japan

[21] Appl. No.: 09/318,374

[22] Filed: May 25, 1999

[30] Foreign Application Priority Data

May 25, 1998 [JP] Japan ..... 10-143030

[51] Int. Cl.[7] ..... F02M 51/00

[52] U.S. Cl. ..... 123/490; 361/154; 361/155; 361/156

[58] Field of Search ..... 123/490, 406.56, 123/406.57; 361/154, 155, 156

[56] References Cited

U.S. PATENT DOCUMENTS

| | | | |
|---|---|---|---|
| 5,216,994 | 6/1993 | Aoki et al. | 123/490 |
| 5,287,839 | 2/1994 | Kondou et al. | 123/490 |
| 5,515,830 | 5/1996 | Arakawa | 123/490 |
| 5,558,065 | 9/1996 | Arakawa | 123/490 |

FOREIGN PATENT DOCUMENTS

| | | |
|---|---|---|
| 26701 | 3/1995 | Japan . |
| 8-61125 | 3/1996 | Japan . |
| 9-144622 | 6/1997 | Japan . |

*Primary Examiner*—Erick R. Solis
*Attorney, Agent, or Firm*—Pearne & Gordon LLP

[57] ABSTRACT

An injector drive circuit capable of driving an injector of an internal combustion engine without using a DC-DC converter expensive. The injector drive circuit includes a power circuit for converting a voltage outputted from a magneto mounted on the engine into a DC voltage, a capacitor charged with a voltage accumulated in a voltage accumulator, a drive current feed circuit for applying a voltage across the capacitor to a solenoid coil to feed a drive current to the solenoid coil when it is fed with an injection command signal, and a holding current feed power supply section for feeding the solenoid coil with a holding current required for keeping a valve open after the drive current fed from the capacitor to the solenoid coil passes a peak value.

9 Claims, 8 Drawing Sheets

360°
TDC
TDC
V1'

θ
V1
Vci

θi1
θi2
θ
Sj

θ
I1
I2

θ
Vc2

Vs2
θ
Vc1

Vs1
θ

INJECTOR DRIVE CIRCUIT

BACKGROUND OF THE INVENTION

This invention relates to an injector drive circuit for driving an injector for feeding an internal combustion engine with fuel, and more particularly to an injector drive circuit which is suitable for use for an internal combustion engine and constructed so as to directly inject fuel into a cylinder of the internal combustion engine.

An injector or electromagnetic fuel injection valve is typically used as a means for feeding fuel to an internal combustion engine.

Such an injector generally includes a valve for operating an injection port and a solenoid coil for driving the valve and is constructed so as to open the valve to inject fuel into a fuel injection space such as an interior of an air inlet pipe, an inner space of a combustion chamber or the like when a drive current of a predetermined magnitude is fed to the solenoid coil.

The injector is mounted on the internal combustion engine while keeping the injection port communicating with the fuel injection space of the internal combustion engine to which fuel is to be injected such as the interior of the air inlet pipe, an interior of a cylinder or the like and is fed therein with fuel under a predetermined pressure from a fuel pump. A pressure of fuel fed to the injector is kept constant by means of a pressure regulator. The solenoid coil is connected to an injector drive circuit. The injector drive circuit functions to feed a drive current to the solenoid coil when it is fed with an injection command signal from a control unit for controlling the injector.

In order to appropriately control the injector, it is required to displace the valve from a closed position to an open position set, to thereby reduce valve opening transition time during which the valve is kept open, as soon as the drive circuit is fed with the injection command signal. Also, it is required to keep the valve at the open position during a period of time for which the drive circuit is fed with the injection command signal, after valve opening operation is completed.

In order to reduce valve opening transition time of the injector supposing that a drive voltage is rendered constant, it is required to increase the number of turns of a coil while increasing a diameter of a wire for the coil to reduce a resistance of the coil per unit length thereof, to thereby permit flowing of a drive current increased in magnitude. However, such construction of the solenoid coil causes the solenoid coil to be increased in volume, leading to large-sizing of the injector, so that a space increased to a degree sufficient to permit the injector to be mounted on the internal combustion engine must be ensured. In particular, when fuel is to be directly injected into the cylinder, it is highly difficult to ensure the space which permits the injector to be mounted on the engine, thus, it is inevitable to prevent large-sizing of the injector.

In order to avoid large-sizing of the injector, it is required to reduce a diameter of a wire conductor for the solenoid coil and decrease the number of turns of the coil to the utmost. However, in order to rapidly carry out operation of opening the injector by means of the solenoid coil thus constructed, it is required to construct the injector drive circuit in a manner to increase a drive voltage applied from a power supply section of the injector drive circuit to the solenoid coil, to thereby ensure rapid rising of a drive current fed to the solenoid coil during starting of the injector and fully increase the drive current. A level of the drive voltage applied to the solenoid coil during the starting depends on a magnitude of initial load of a return spring used for the injector or a magnitude of elastic force of the return spring provided when the solenoid coil is kept from being excited.

When fuel is injected into the air inlet pipe of the internal combustion engine, an environmental pressure of the injector is at a level of an atmospheric pressure or below. Also, it is as low as about 0.5 MPa even when the engine is mounted thereon with a supercharger. Thus, in the injector used for injection of fuel into the air inlet pipe, it is not required to increase initial load of the return spring to a significantly increased level, so that the solenoid coil may be driven at a power supply voltage of 12 V applied from a battery thereto while being small-sized.

On the contrary, the injector for direct injection of fuel into the cylinder is increased in environmental pressure, therefore, it is required to increase initial load of the return spring to a considerable level.

Thus, in order to reduce valve opening transition time of the injector to improve controllability of a fuel injection rate when the injector operated under an increased environmental pressure is driven, it is required that a DC-DC converter for increasing a voltage outputted from a battery is arranged so as to provide the injector with a drive voltage therefrom, as disclosed in Japanese Patent Application Laid-Open Publications Nos. 144622/1997 and 26701/1995. Unfortunately, this causes a structure of the power supply section of the injector drive circuit to be complicated, leading to an increase in manufacturing cost of the injector drive circuit.

Another injector drive circuit is disclosed in Japanese Patent Application Laid-Open Publication No. 61125/1996. The injector drive circuit disclosed is constructed so as to charge a capacitor by means of a fly-back voltage induced across a primary winding of an ignition coil of an ignition device when a current flowing through the primary winding of the ignition coil is interrupted at an ignition position of an internal combustion engine, to thereby apply a voltage at an increased level across the capacitor to a solenoid coil, resulting in driving the injector at an increased speed. However, such construction of charging the capacitor by means of a high voltage induced across the primary winding of the ignition coil at an ignition position of the engine tends to deteriorate ignition performance of the ignition coil, resulting in being disadvantageous, because the capacitor acts as a load for a primary circuit of the ignition coil.

SUMMARY OF THE INVENTION

The present invention has been made in view of the foregoing disadvantages of the prior art.

Accordingly, it is an object of the present invention to provide an injector drive circuit which is capable of reducing valve opening transition time of an injector to satisfactorily control a fuel injection rate without using any complicated circuit such as a DC-DC converter while simplifying a structure thereof and preventing a solenoid coil of the injector from being large-sized.

It is another object of the present invention to provide an injector drive circuit which is capable of reducing valve opening transition time of an injector to satisfactorily control a fuel injection rate without adversely affecting ignition performance of an ignition device for an internal combustion engine.

In accordance with the present invention, an injector drive circuit is provided which is adapted to drive, in response to an injection command signal having a time width corresponding to fuel injection time, an injector which includes a valve for operating an injection port and a solenoid coil for driving the valve and is constructed so as to open the valve to inject fuel into a fuel injection space of an internal combustion engine when the solenoid coil is fed with a predetermined drive current. The injector drive circuit includes a power circuit for outputting a first DC voltage having a level equal to or above a level of a drive voltage required to be applied to the solenoid coil when the valve is rendered open while using a magneto driven by the internal combustion engine as a power supply therefor, a voltage accumulation means for accumulating the first DC voltage therein, a capacitor charged by means of the voltage accumulated in the voltage accumulation means during a period of time for which the injection command signal is kept from being generated, a drive current feed circuit for applying a voltage across the capacitor to the solenoid coil to feed the drive current to the solenoid coil when it is fed with the injection command signal, and a holding current feed power supply section for feeding the solenoid coil with a holding current required to keep the valve open after the drive current fed from the capacitor to the solenoid coil passes a peak value.

Such construction of the present invention permits the capacitor to be charged to a voltage at a sufficiently increased level required for opening the valve, to thereby permit a starting current of which rising is rapidly carried out to be fed to the solenoid coil by increasing the number of turns of a generating coil arranged in the magneto to increase a crest value of a voltage applied from the magneto to the power circuit. Thus, the injector drive circuit of the present invention reduces valve opening transition time of the injector without using any complicated circuit such as a DC-DC converter while being simplified in structure. After the injector is rendered open, a holding current is fed from the holding current feed power supply section to the solenoid coil to keep the valve of the injector open.

When the injector is driven using the magneto as a power supply therefor, it would be considered to feed a rectified output of the magneto directly to the injector. However, application of a rectified output of the magneto directly to the injector causes a drive voltage applied to the injector to be varied with a change in instantaneous value of an AC voltage, to thereby render stable driving of the injector difficult. Also, when the injector is driven directly by means of a rectified output of the magneto, feeding of a drive current of a predetermined magnitude to the injector is attained only during a period of time for which an instantaneous value of each of half waves of the AC voltage is kept at a predetermined level or more, so that a rotation angle position of the internal combustion engine which permits driving of the injector is restricted, resulting free setting of fuel injection time of the injector as in use of a DC-DC converter being failed.

On the contrary, the present invention, as described above, is so constructed that an AC voltage generated from the magneto driven by the internal combustion engine is converted to a DC voltage, which is accumulated in the voltage accumulation means, and the capacitor is charged by means of the voltage accumulated in the voltage accumulation means during a period of time for which the injection command signal is kept from being generated, to thereby apply a voltage across the capacitor to the injector when the injection command signal is fed, resulting in feeding a drive current to the injector. Such construction permits the injector to be driven at any desired rotation angle position of the engine using an AC voltage generated from the magneto as a power voltage therefor and irrespective of a phase of the AC voltage, as in use of a DC-DC converter. Thus, the present invention permits the injector to be driven at any desired rotation angle position of the engine without any limitation as in use of an expensive DC-DC converter.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, wherein.

BRIEF DESCRIPTION OF THE PREFERRED EMBODIMENTS

Now, an injector drive circuit according to the present invention will be described hereinafter with reference to the accompanying drawings.

Figure 8:
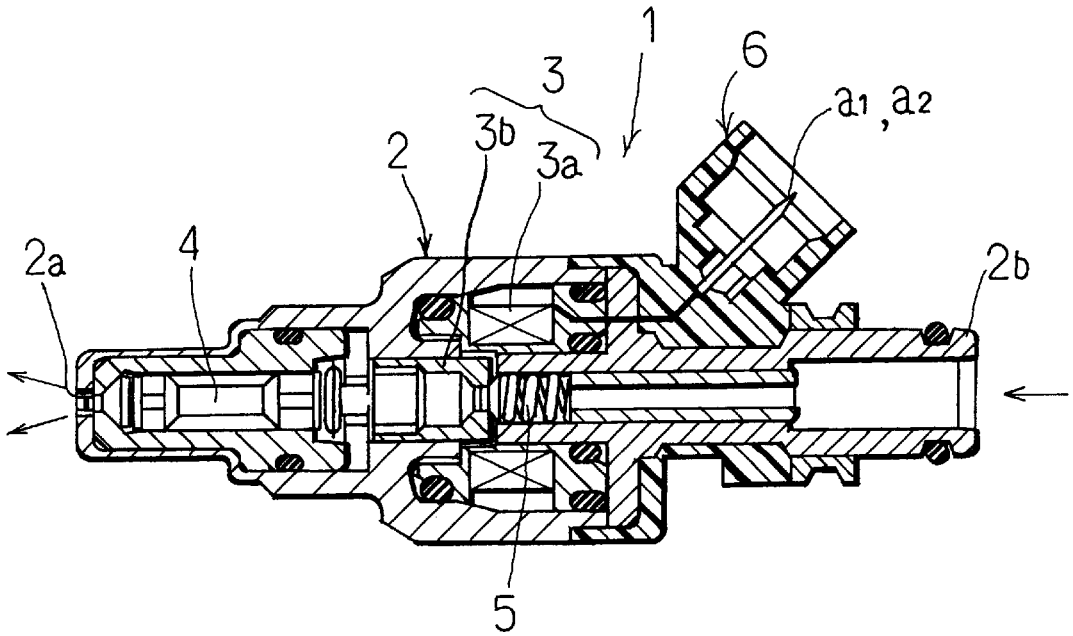
FIG. 8 is a sectional view showing a structure of an injector by way of example.

An injector driven by an injector drive circuit according to the present invention may be constructed in such a manner as shown in FIG. 8 by way of example. More particularly, the injector generally designated at reference numeral 1 includes an injector body 2 provided at a front end thereof with an injection port 2*a* and at a rear end thereof with a fuel connector 2*b*. Also, the injector 1 includes a solenoid (electromagnet) 3 including a solenoid coil 3*a* and a movable core 3*b* displaced when a current is fed to the solenoid coil 3*a* and is received in the injector body 1. The injector 1 also includes a needle valve 4 coupled to the movable core 3*b* of the solenoid 3 and displaced between a closed position at which the injection port 2*a* is closed with displacement of the movable core 3*b* and an open position at which the injection port 2*a* is rendered open with the displacement, as well as a return spring 5 for biasing the needle valve 4 through the movable core 3*b* toward the closed position. The injector body 2 is provided on the rear end thereof described above with an electrical connector 6 which has terminals a1 and a2 connected to one end of the solenoid coil 3*a* and the other end thereof, respectively.

The injector 1 shown in FIG. 8 is mounted on an internal combustion engine while keeping the injection port 2*a* communicating with a fuel injection space of the internal combustion engine and is constructed so as to permit fuel to be fed under a predetermined pressure from a fuel pump (not shown) through the fuel connector 2*b* to the injector body 2. A pressure of the fuel fed to the injector body 2 is kept constant by means of a pressure regulator. The solenoid coil 3*a* is connected to an injector drive circuit (not shown in FIG. 8) via an electrical cord which is then connected through a plug to the connector 6, so that a drive current may be fed from the injector drive circuit to the solenoid coil: 3*a* when it is fed with an injection command signal from a control unit (not shown).

When the solenoid coil 3*a* is kept from being fed with a drive current, the valve 4 is kept urged toward the closed position by the return spring 5, resulting in the injection port 2*a* being kept liquid-tightly closed. When a drive voltage at a predetermined level is applied to the solenoid valve 3*a* under such conditions, to thereby feed the solenoid coil 3*a* with a drive current of a predetermined magnitude, the movable core 3*b* is displaced toward the solenoid coil 3*a*, resulting in the needle valve 4 starting to be displaced toward the open position or in a right-hand direction in FIG. 12, so that a gap may be defined between the needle valve 4 and the injection port 2*a*. Fuel is injected through the gap thus formed. A sectional area of the gap formed between the injection port 2*a* of the injector 2 and the needle valve 4 and a sectional configuration thereof are varied depending on displacement of the movable core 3*b*. Thus, when the valve 4 reaches the open position set, the defined gap which has a sectional area and a sectional configuration designed is permitted to be formed between the injection port 2*a* and the valve 4, resulting in injector opening operation being completed.

When the injection command fed to the injector drive circuit is extinguished, to thereby reduce the drive current, the movable core 3*b* is displaced toward the closed position by urging force of the return spring 5, resulting in the valve being returned to the closed position, so that the injection port 2*a* may be closed.

The injector 1 thus equipped with the return spring 5 causes backflow of fuel, when the valve 4 is pushed back by an environmental pressure in the fuel injection space to thereby render the injection port 2*a* open. In order to prevent the backflow, it is required that initial load of the return spring 4 which is urging force of the return spring 5 exhibited when the solenoid coil is kept from being energized is set at a level sufficient to overcome the environmental pressure. Also, when the injector is driven, it is required to move the movable core 3*b* toward the open position against urging force of the return spring 5. The environmental pressure in the fuel injection space means a pressure in an air inlet pipe of the internal combustion engine when fuel is injected into the air inlet pipe or a pressure in a combustion chamber of the engine kept compressed by a piston when fuel is injected directly into the cylinder.

Such an injector requires a drive current of an increased magnitude in order to rapidly carry out valve opening operation when it overcomes urging force of the return spring 5 to render the injection port 2*a* open. However, in order that the injection port once open is kept open, a drive current of a magnitude thus increased is not required. Thus, a holding current at a magnitude below a peak value of the drive current required during opening of the injection port 2*a* is merely required in order to hold the injection port 2*a* open. Thus, the injector drive circuit is constructed so as to feed a drive current of an increased magnitude to the solenoid coil 3*a* during the operation of opening the injection port 2*a* and reduce the drive current to a magnitude of the holding current once the injection port 2*a* is rendered open.

In general, the injector drive circuit is constituted of a drive current control switch connected in series to the solenoid coil of the injector and kept turned on during a period of time for which it is fed with an injection command signal, as well as a power circuit for applying a drive voltage across a series circuit of the drive current control switch and solenoid coil. The drive current control switch is turned on when it is fed with an injection command signal from the control unit and turned off when the injection command signal is extinguished.

The power circuit functions to apply a drive voltage at an increased level across the solenoid coil to feed a drive current of a magnitude increased to a degree sufficient to render the valve of the injector open to the solenoid coil, when the drive current control switch is turned on in response to the injection command signal. The power circuit also functions to reduce the drive voltage applied to the solenoid coil to a low level to reduce a magnitude of the drive current fed to the solenoid coil to a magnitude of a holding current after the valve of the injector is rendered open.

Figure 9:
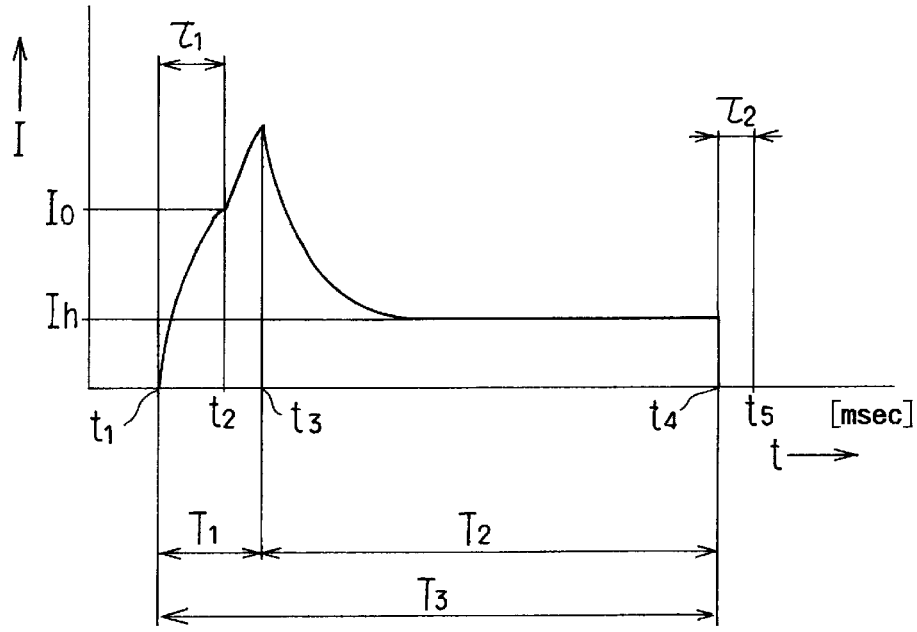
FIG. 9 is a waveform chart showing a waveform of a drive current fed to an injector by way of example.

The drive current fed to the solenoid coil during driving of the injector may have a waveform shown in FIG. 9 by way of example. In FIG. 9, a period T1 is defined so as to apply a drive voltage at an increased level across the solenoid of the injector to permit a drive current of a magnitude increased to a degree sufficient to render the valve of the injector open to be fed to the solenoid coil. A period T2 is set for varying a voltage applied across the solenoid coil to a level lower than the voltage applied during the period T1 to reduce the drive current to a magnitude of a holding current. Also, a period T3 is set so as to apply a voltage across the solenoid coil of the injector or keep the injector drive switch turned off.

In FIG. 9, the injector drive circuit is fed with an injection command signal at time t1 and the injection command signal is extinguished at time t4. When the injection command signal is fed at the time t1, the drive current control switch connected in series to the solenoid coil is turned on, to thereby permit a drive current I to be fed to the solenoid coil. The drive current I is exponentially increased at a predetermined rate of change with time determined depending on inductance of the solenoid coil and a crest value of the drive voltage. when lag time $\tau 1$ elapses after feeding of the injection command signal, resulting in the drive current I reaching a predetermined starting current Io, suction force acting on the movable core of the solenoid exceeds initial load of the return spring, so that the movable core starts to be moved toward the solenoid coil, to thereby permit the valve to reach the open position set until time t3, resulting in injector opening operation being completed. The drive voltage is changed to a low level at the time t3. This permits the drive current I to be reduced to a holding current Ih lower than the starting current Io and equal to a holding current required for holding the valve at the open position or more.

When the injection command signal is extinguished at the time t4, the drive current control switch is rendered open, so that the drive current I is rendered zero. When the drive current I is thus rendered zero, the valve is returned to the closed position by urging force of the return spring, so that injector closing operation is completed. Lag time τ2 between the time at which the drive current of the injector is rendered zero and the time at which the injector closing: operation is completed is determined depending on urging force of the return spring.

A fuel injection rate which is a rate of fuel injected from the injector or a fuel feed rate at which fuel is fed to the internal combustion engine is determined by a product between a period of time during which the valve of the injector is kept open and a pressure of fuel fed from the fuel pump into the injector body. A pressure of fuel fed into the injector body is controlled to be constant by the pressure regulator, so that the fuel injection rate may be controlled by controlling valve open time during which the injection port of the injector is kept open or controlling a time width of the injection command signal.

In the injector, a sectional configuration of the gap between the valve and the injection port and a sectional area thereof serve as essential factors for determining a rate of injection of fuel, an angle of spray of fuel, a diameter of sprayed particles of fuel and a velocity of the sprayed particles. Thus, in order to accurately control the fuel injection rate, it is required that the sectional configuration and sectional area of the gap between the valve and the injection port during injection of fuel are kept constant. A transition state in which the valve is displaced from the closed position to the open position fails to permit fuel to be normally injected from the injection port and causes leakage of fuel, resulting in failing to be used for controlling the fuel injection rate.

Thus, accurate control of the injector requires to displace the valve 4 from the closed position to the open position set, to thereby reduce valve opening transition time of the injector. Also, after valve opening operation is completed, it is required to hold the valve 4 at the open position during a period of time for which the injection command signal is fed.

When the injector is used for injection of fuel into the air inlet pipe, it is not required to increase initial load of the return spring so much because an environmental pressure of the injector is decreased. Thus, the injector may be driven by means of a relatively simplified drive circuit using a battery as a power supply therefor.

On the contrary, when the injector is used for injecting fuel directly into the cylinder (combustion chamber) of the internal combustion engine, it is required to increase initial load of the return spring to a considerable level because the environmental pressure is increased.

Figure 10:
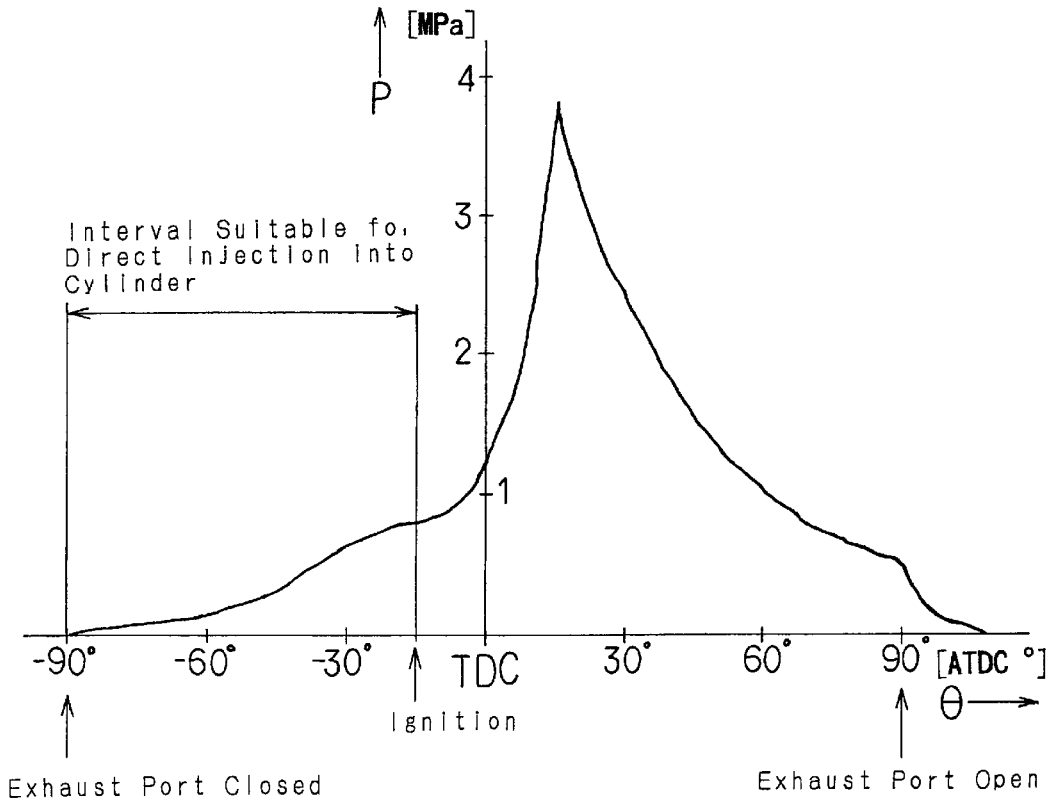
FIG. 10 is a diagrammatic view showing a variation in pressure in a combustion chamber with a change in stroke of a two-cycle internal combustion engine.

FIG. 10 shows a variation in pressure in a cylinder of a two-cycle internal combustion engine with a change in stroke thereof by way of example, wherein an axis of abscissas indicates a rotation angle θ (ATDC°) of a crank shaft of the engine and an axis of ordinates indicates a pressure (MPa) in the cylinder.

ATDC is an abbreviation of "after top dead center" and means that the crank shaft is delayed with respect to a rotation angle position of the crank shaft obtained when the piston reaches a top dead center. The ATCD° indicates an angle measured on a side delayed with respect to a rotation angle position of the engine corresponding to the top dead center.

As will be readily noted from FIG. 10, a pressure in the cylinder is increased to a level as high as about 4 MPa immediately after ignition of the engine. Thus, the return spring incorporated in the injector used in this case is required to exhibit initial load sufficient to permit the return spring to withstand a pressure up to 4 MPa. In this instance, the solenoid of the injector is required to generate force overcoming such increased initial load of the return spring. Thus, in order to ensure satisfactory operation of the injector while using the solenoid coil reduced in wire diameter thereof and decreased in the number of turns, it is required to feed a drive current advanced in rising and increased in magnitude to the solenoid coil using a power supply capable of outputting a voltage above the battery voltage of 12 V as a power supply section for the injector drive circuit.

When direct injection of fuel into the cylinder of the two-cycle internal combustion engine shown in FIG. 10 is carried out, an interval suitable for fuel injection is between a position at which an exhaust port is closed and ignition of the engine.

The injector drive circuit of the present invention is so constructed that an AC voltage having a crest value equal to or above a level of a drive voltage required to be applied across the solenoid coil during operation of opening the valve of the injector is generated from a magneto driven by the internal combustion engine and then converted into a DC voltage, followed by storage in a voltage accumulation means. Also, in the injector drive circuit of the present invention, a capacitor is charged by means of a voltage accumulated in the voltage accumulation means during a period of time for which the injection command signal is kept from being generated. Also, when it is fed with the injection command signal, a voltage across the capacitor is applied to the solenoid coil, to thereby permit the drive current to be fed to the solenoid coil. After the drive current fed from the capacitor to the solenoid coil passes a peak value thereof, a holding current required for holding the valve open is fed from a power supply section for feeding of the holding current to the solenoid coil, to thereby keep the valve open during a period of time for which the injection command signal is fed.

Figure 1:
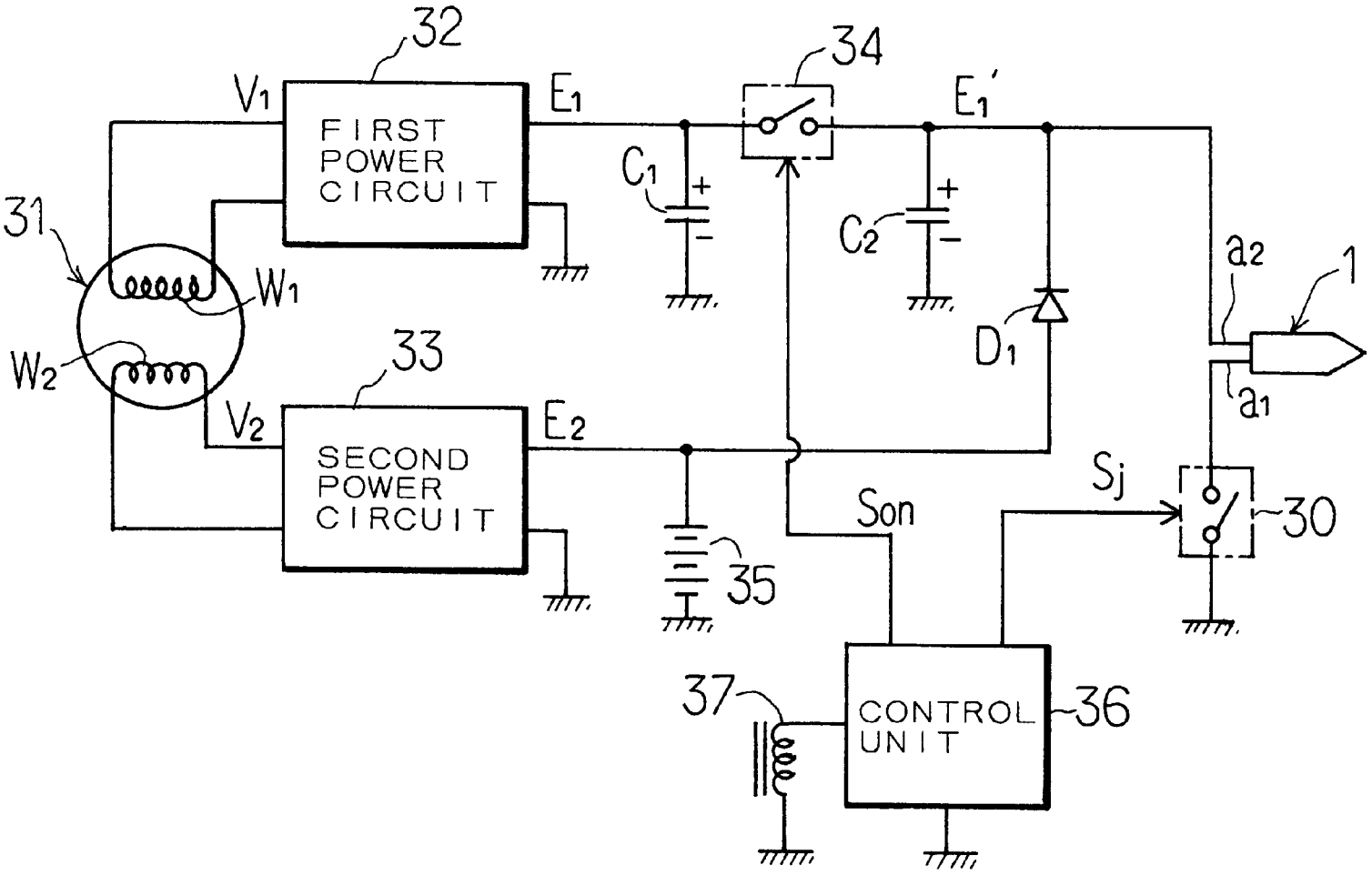
FIG. 1 is a circuit diagram showing an embodiment of an injector drive circuit according to the present invention.

Referring now to FIG. 1, an embodiment of an injector drive circuit according to the present invention is illustrated. In the illustrated embodiment, an internal combustion engine to which the embodiment is applied is constructed into a single-cylinder structure. In FIG. 1, reference numeral 1 designates an injector mounted on an internal combustion engine for injection of fuel into a cylinder of the engine while rendering an injection port of the injector communicating with a combustion chamber of the engine. The injector 1 is provided with a connector, which has a first power terminal a1 and a second power terminal a2 connected to one end of a solenoid coil and the other end thereof, respectively. The first power terminal a1 of the injector 1 connected to one end of the solenoid coil is connected to a grounded circuit through a drive current control switch constituted of an on-off controllable semiconductor switch element such as a transistor, an FET or the like.

Reference numeral 31 designates a magneto driven by the internal combustion engine to output an AC voltage. The magneto 31 includes a magnet rotor mounted on a crank shaft of the engine and a stator mounted on a casing of the engine or the like. The stator of the magneto 31 includes at least a first generating coil W1 and a second generating coil W2. The first generating coil W1 is significantly increased in the number of turns so as to output a first AC voltage V1 having a crest value equal-to a level of a drive voltage required to be applied across the solenoid coil in order to feed a current of a magnitude equal to or above a predetermined magnitude of a starting current in the form of a drive current for opening a valve of the injector to the solenoid coil of the injector 1. The second generating coil W2 has the number of turns reduced as compared with the first generating coil W1, to thereby output a second AC voltage V2 which is decreased in crest value as compared with that of the output voltage of the first generating coil W1.

Figure 2:
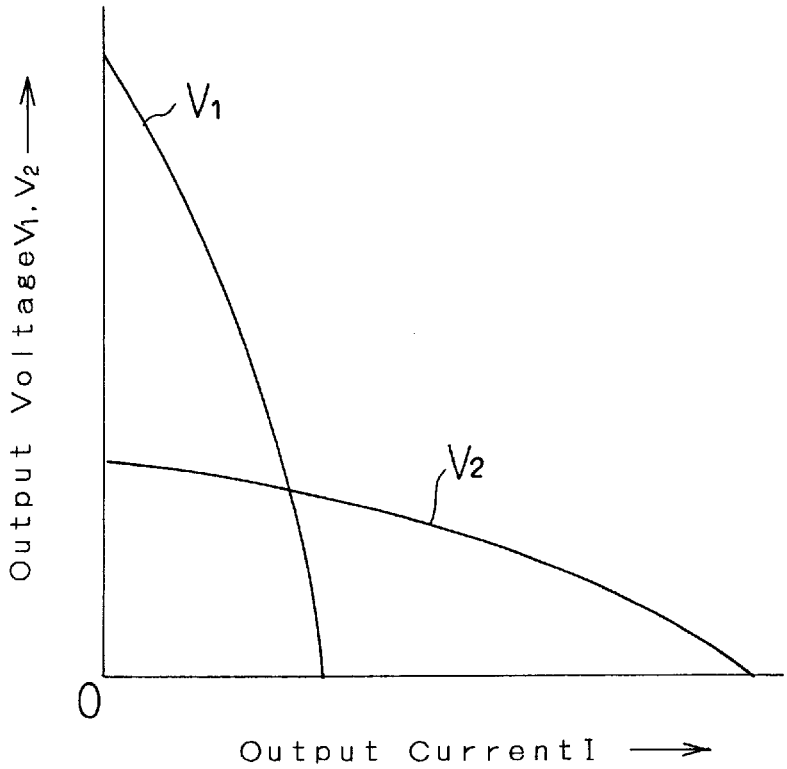
FIG. 2 is a diagrammatic view showing output voltage-output current characteristics of a magneto used in the present invention by way of example.

FIG. 2 shows output voltage V1-output current I characteristics of the first generating coil W1 of the magneto 31 suitable for use in the present invention, as well as output voltage V2-output current I characteristics of the second generating coil W2 thereof. As will be noted from FIG. 2, the first generating coil W1 increased in the number of turns exhibits characteristics of generating a voltage at an increased level during non-load and being rapidly reduced in output voltage with an increase in load current. Whereas, the second generating coil W2 reduced in the number of turns has characteristics of being relatively decreased in output voltage during non-load and restraining a significant reduction in output voltage with an increase in load current, to thereby provide an increased output current.

The first output voltage V1 of the first generating coil W1 is inputted to a first power circuit 32 and the output voltage V2 of the second generating coil W2 is inputted to a second power circuit 33. The first power circuit 32 includes a rectification circuit for rectifying the output voltage of the first generating coil W1 and a regulator for carrying out control of keeping an output voltage of the rectification circuit at a predetermined level or below and generates a first DC voltage E1 at a starting level or above which is required to be applied to the solenoid coil in order to permit feeding of a drive current equal to or above a predetermined starting current value Io which is set to be much larger than a holding current value to the solenoid coil.

The first power circuit 32 has a negative polarity output terminal grounded, as well as a first capacitor C1 connected between a positive polarity output terminal thereof and the ground. The first capacitor C1 is charged to a level of the first DC voltage E1.

Reference character C2 designates a second capacitor of which one end is grounded. The first capacitor C1 is connected at a non-grounded terminal thereof to a non-grounded terminal of the second capacitor C2 through a charge control switch 34 constituted by an on-off controllable semiconductor switch element such as a transistor or the like, so that the voltage E1 across the first capacitor C1 may be applied across the second capacitor C2 through the charge control switch 34. The second capacitor C2 is charged to a level of a voltage E1' through the switch 34 by means of the voltage E1 across the first capacitor C1. The charging voltage E1' of the second capacitor C2 has a level up to a magnitude obtained by subtracting a voltage drop across the switch 34 from the voltage E1 across the first capacitor C1. In the illustrated embodiment, a level of the first DC voltage E1 (a charging voltage of the first capacitor C1), a period of time during which the switch 34 is kept turned on, and a charge time constant of the second capacitor C2 are so set that the charging voltage E1' of the second capacitor C2 may have a level equal to or above that of a voltage required to be applied to the solenoid coil of the injector 1 in order to permit a drive current larger than the starting current Io to be fed to the solenoid coil.

The first capacitor C1 has an electrostatic capacity much larger than that of the second capacitor C2, so that the second capacitor C2 may be repeatedly charged to a level of the predetermined voltage E1' by means of charges accumulated in the first capacitor C1 charged with the output voltage of the first power circuit 32 over the number of times corresponding to the number of cylinders of the internal combustion engine.

The non-grounded terminal of the second capacitor C2 is connected to the second power terminal a2 connected to the other end of the solenoid coil of the injector, so that a voltage across the second capacitor C2 may be applied across a series circuit of the solenoid coil and drive current control switch 30.

The second power circuit 33 includes a rectification circuit for rectifying the output voltage of the second generating coil W2 and a regulator for carrying out control of keeping an output voltage of the rectification circuit at a predetermined level or below and is grounded at a negative polarity output terminal thereof. The second power circuit 33 functions to rectify the second AC voltage V2 to generate a second DC voltage E2 at a level which is required to be applied to the solenoid coil of the injector in order to permit a current of a magnitude lower than the starting current of the injector and equal to or above a holding current value Ih to be fed in the form of a holding current to the solenoid coil. The term "holding current value" used herein indicates a lowermost value of a drive current required to be fed to the solenoid coil in order to hold the valve of the injector 1 once rendered open at an open position. This is the same as a level Ih shown in FIG. 9.

The output voltage E2 of the second power circuit 33 is applied across the series circuit of the solenoid coil and drive current control switch 30 through a holding current feed diode D1 forwardly arranged with respect to the drive current fed to the solenoid coil of the injector 1.

Reference numeral 36 designates a control unit (ECU) for controlling the drive current control switch 30 and charge control switch 34 by means of a microcomputer. The control unit is fed with an output of a signal coil 37 arranged in a signal generator mounted on the internal combustion engine. The signal coil 37 outputs a pulse signal at a predetermined rotation angle position of a crank shaft of the internal combustion engine. The control unit 36 is fed with outputs of various sensors (not shown) such as a temperature sensor for detecting a temperature of the internal combustion engine, a throttle sensor for detecting a degree of opening of the throttle valve through a predetermined interface, so that a rotation angle position of the crank shaft at which fuel injection is started (injection start position) and a period of time during which fuel injection is carried out (fuel injection time) are operated on the basis of various control conditions obtained by the sensors, information on a rotation angle position of the engine obtained from the pulse signal outputted by the signal coil 37 and information on a rotational speed of the engine. Then, when the injection start position thus operated is detected, a control terminal of the drive current control switch 30 is fed with an injection command signal Sj of a rectangular wave-like form having a time width corresponding to the fuel injection time. The drive current control switch 30 is kept turned on during a period of time for which it is fed with the injection command signal Sj, to thereby permit the drive current to be fed to the solenoid coil of the injector 1. The control unit 36 also functions to generate a drive signal Son for keeping the charge control switch 34 turned on only during a short period of time for which the injection command signal Sj is extinguished, to thereby feed the drive signal Son to the control terminal of the charge control switch 34. The charge control switch 34 is kept turned on only for a short period of time during which it is fed with the drive signal Son, resulting in charges accumulated in the first capacitor C1 being fed to the second capacitor C2.

In the illustrated embodiment, a circuit extending from the first capacitor C1 through the charge control switch 34 and second capacitor C2 to the first capacitor C1 constitutes a capacitor charging circuit for charging the second capacitor C2 with a voltage across the first capacitor during a period of time for which the injection command signal Sj is extinguished.

In the injector drive circuit shown in FIG. 1, rotation of the crank shaft of the internal combustion engine permits the first generating coil W1 and second generating coil W2 of the magneto 31 to generate a first AC voltage V1 and a second AC voltage V2, respectively. The first generating coil W1 has the number of turns substantially increased as compared with that of the second generating coil W2, so that the first AC voltage V1 may have a crest value higher than that of the second AC voltage V2. Then, the first power circuit 32 converts the first AC voltage V1 into a first DC voltage E1 at a level higher than that of a voltage required to be applied to the solenoid coil of the injector 1 in order to permit a drive current of a magnitude equal to or above that of a starting current value Io to be fed in the form of a starting current to the solenoid coil. The second power circuit 33 converts the second AC voltage V2 into a second DC voltage E2 at a level required to be applied to the solenoid coil of the injector 1 so as to permit a drive current of a magnitude below that of the starting current value Io and equal to or above that of a holding current value Ih to be fed in the form of a holding current to the solenoid coil.

The first capacitor C1 is charged at polarities shown in FIG. 1 by means of the first DC voltage E1 and the battery 35 is charged by means of the second DC voltage E2. Also, the charge control switch 34 is fed with a drive signal Son reduced in pulse width when an injection command signal Sj fed from the control unit to the drive current control switch 30 is extinguished, resulting in the switch 34 being turned on for only a short period of time, so that the second capacitor C2 may be charged to a level of a voltage E1' at polarities shown in FIG. 1 by means of a voltage across the first capacitor C1. The voltage E1' is set to be at a level required to be applied to the solenoid coil of the injector in order to permit a drive current of a magnitude equal to or above the starting current value to be fed in the form of the starting current to the solenoid coil of the injector. Thus, the voltages E1' and E2 have relationship E1'>E2 defined therebetween.

The voltage E1' across the second capacitor C2 is applied to the series circuit of the solenoid coil of the injector 1 and the switch 30. At this time, the diode D1 is reversely biased, resulting in preventing the drive current from being fed from the second power circuit 33 through the diode D1 to the injector. Thus, the voltage E1' across the second capacitor C2 permits a starting current to flow through the solenoid coil of the injector 1 and the switch 30. When the starting current exceeds the starting current value Io, the valve of the injector 1 starts to be displaced toward the open position and then reaches the open position after a slight amount of lag time elapses. The voltage E1' across the second capacitor C2 is set at a level highly increased to a degree sufficient to permit a starting current of which rising is substantially advanced to flow through the solenoid coil of the injector 1 and permit the valve of the injector 1 to reach the open:position before the starting current reaches a peak value, to thereby complete injector opening operation.

The voltage across the second capacitor C2 is decreased with discharge of the second capacitor C2, so that the drive current fed to the solenoid coil of the injector 1 is decreased correspondingly. When the voltage E1' across the second capacitor C2 is decreased to a level lower than that of the output voltage E2 of the second power circuit 33, the diode D1 is forwardly biased, so that a holding current may be fed from the second power circuit 33 through the diode D1 to the solenoid coil of the injector 1. When the injection command signal Sj generated from the control unit 36 is extinguished, the drive current control switch 30 is turned off, resulting in the drive current fed to the solenoid coil of the injector 1 being interrupted. When a predetermined length of lag time elapses after interruption of the drive current, the valve is returned to the closed position by elastic force of the return spring. When the injection command signal Sj is extinguished, the control unit 36 feeds the charge control switch 34 with a drive signal Son reduced in signal width, so that the charge control switch 34 may be turned on for a short period of time. This permits a voltage across the first capacitor C1 to be applied to the second capacitor C2, resulting in the second capacitor C2 being charged to a level of the voltage E1' for the next fuel injection.

The above-described operation is repeated, so that fuel may be injected from the injector 1 every time when it is fed with the injection command signal.

It would be considered that the injector drive circuit described above permits the injector to be driven directly by means of the voltage E1 obtained by rectifying the output voltage of the first generating coil W1. However, the first generating coil W1 increased in the number of turns fails to permit flowing of a load current increased in magnitude therethrough, so that feeding of a starting current of a highly increased magnitude equal to or above the starting current value Io to the solenoid coil of the injector is rendered difficult.

On the contrary, the illustrated embodiment, as described above, is so constructed that the output energy of the first generating coil W1 is temporarily stored in the first capacitor C1 when the injection command signal is not generated and then transferred to the second capacitor C2, resulting in the voltage across the second capacitor C2 being applied to the solenoid coil of the injector 1. Such construction permits not only a starting voltage at a highly increased level to be applied to the solenoid coil but flowing of a starting current of a significantly increased magnitude exceeding the starting current value Io. Thus, the illustrated embodiment permits the operation of opening the valve 4 of the injector 1 to be quickly carried out to reduce valve opening transition time without a DC-DC converter for increasing a voltage of the battery, even when the return spring is increased in elastic force as in direct injection of fuel into the cylinder.

Also, the illustrated embodiment is so constructed that the second capacitor C2 is charged by means of a voltage across the first capacitor C1 charged by means of the output voltage E1 of the first power circuit 32 using the magneto as a power supply therefor while the injection command signal is kept from being generated, resulting in a voltage across the second capacitor C2 being applied across the series circuit of the solenoid coil of the injector 1 and the switch 30, to thereby feed a starting current to the solenoid coil 3*a*. Such construction permits the operation of opening the valve 4 of the injector 1 to be rapidly carried out, to thereby reduce the valve opening transition time by merely substantially increasing the number of turns of the first generating coil W1 to fully increase the output voltage E1 of the first power circuit 32. This effectively prevents an increase in leakage of oil from the injection port 2*a* due to an increase in time required before the valve 4 reaches the open position, resulting in reducing minimum electricity feed time Timin of the injector. Such a reduction in minimum electricity feed time Timin leads to an increase in ratio Timax/Timin between maximum electricity feed time Timax determined depending on a structure of the injector and the minimum electricity time Timin, to thereby increase an adjustment width of a fuel injection rate of the injector 1, resulting in enhancing controllability of the fuel injection rate. The term "maximum electricity feed time" indicates a maximum value of electricity feed time determined depending on a period of time required for rendering the valve stationary when operation of opening and closing the needle valve 4 is repeated. Also, a length of time required for opening the valve 4 is reduced, so that the amount of fuel injected during each rotation of the internal combustion engine may be increased.

Also, the charging voltage of the second capacitor C2 is kept at an increased level, to thereby ensure quick rising of the starting current fed to the solenoid coil 3*a*, so that valve opening transition time may be significantly reduced, resulting in enhancing controllability of the fuel injection rate even when a fuel injection start position of the internal combustion engine is substantially varied.

As described above, the construction of the illustrated embodiment that the first capacitor C1 is charged by means of an output of the first power circuit and the second capacitor C2 is charged by means of a voltage across the first capacitor permits charging of the first capacitor C1 irrespective of a phase of an output of the magneto, resulting in the magneto being effectively utilized, so that the injector 1 may be driven at any desired rotation angle position without any limitation as in use of the DC-DC converter.

In the illustrated embodiment, the charge control switch 34 is fed with a drive current, resulting in being tuned on when the injection command signal Sj falls to a zero level. However, the charge control switch may be turned on at any time during a period of time for which the injection command signal is kept from being generated or during a period of time for which the drive current controls witch 30 is turned off. Thus, turning-on of the switch 34 is not limited to time at which the injection command signal falls.

Also, in the illustrated embodiment, the output current of the second power circuit 33 is fed in the form of a holding current to the solenoid coil 3*a* of the injector 1 without any processing or treatment. Alternatively, a constant-current circuit may be connected between the output terminal of the second power circuit 33 and the holding current feed diode D1, so that a constant current may be fed in the form of a holding current from the second power circuit 33 through the diode D1 to the injector 1.

Figure 3:
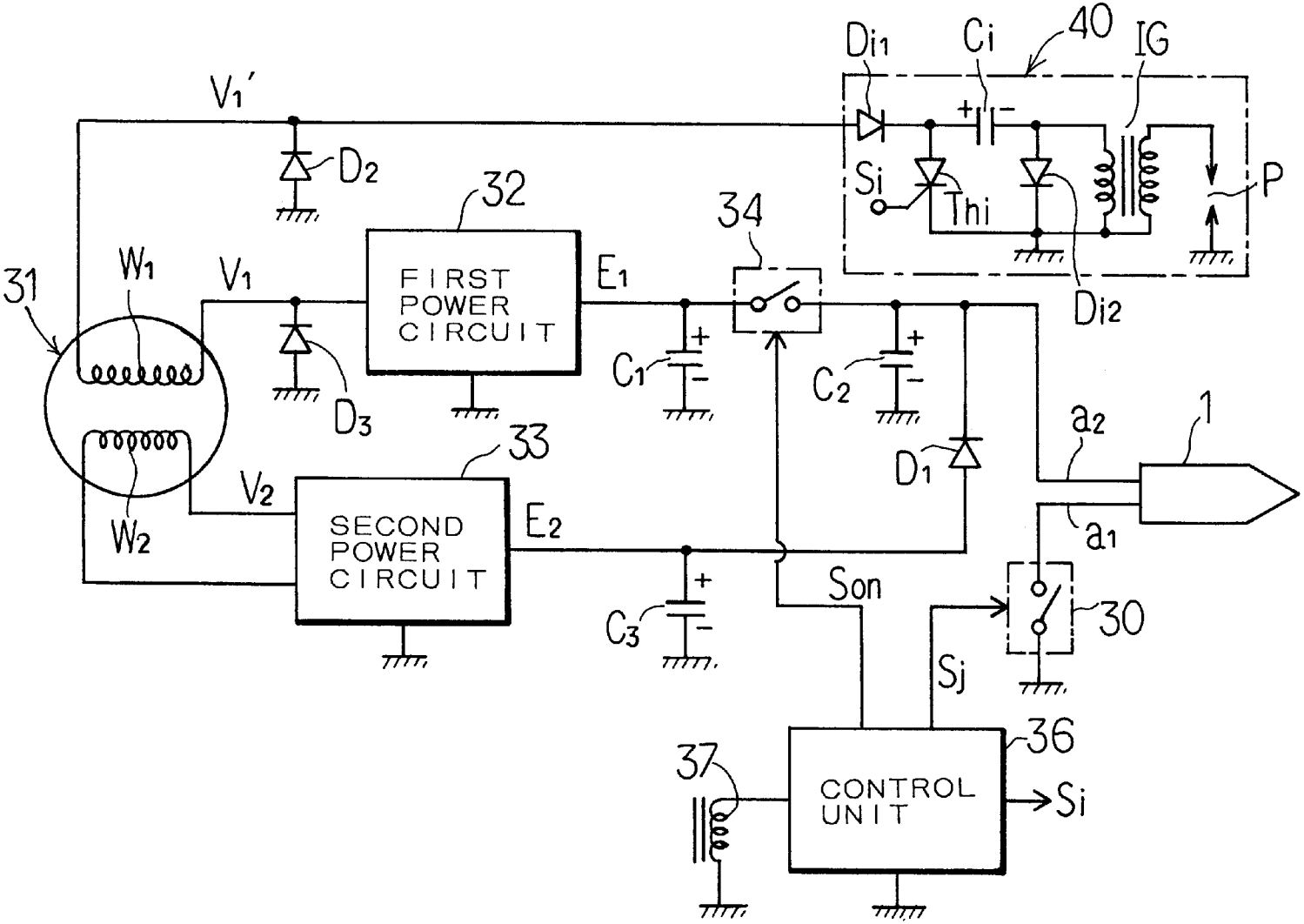
FIG. 3 is a circuit diagram showing another embodiment of an injector drive circuit according to the present invention.

Referring now to FIG. 3, another embodiment of an injector drive circuit according to the present invention is illustrated. An injector drive circuit of the illustrated embodiment is constructed in such a manner that an exciter coil arranged in a magneto 31 so as to drive an ignition device 40 of the capacitor discharge type for an internal combustion engine acts as a first generating coil W1. The first generating coil or exciter coil W1 is connected at one end thereof to both a cathode of a current feedback diode D2 of which an anode is grounded and a power input terminal of the ignition device. The first generating coil W1 is connected at the other end thereof to both a cathode of a current feedback diode D3 of which an anode is grounded and an input terminal of a first power circuit 32, so that an output voltage V1' of one half cycle of the first generating coil may be inputted to the ignition device 40 and an output voltage V1 of the other half cycle thereof may be inputted to the first power circuit 32. The first power circuit 32 includes a rectification element and a constant-voltage circuit for carrying out control of holding a DC voltage outputted through the rectification element at a constant level and includes an output terminal for outputting a first DC voltage E1.

The ignition device 40 generally includes an ignition coil IG including a primary winding and a secondary winding, an capacitor C1 for ignition arranged on a primary side of the ignition coil IG and charged at one polarity through a diode Di1 by means of the output voltage of one half cycle of the exciter coil W1, and a thyristor Thi arranged so as to discharge charges in the capacitor Ci through the primary winding of the ignition coil IG when it is turned on.

In the illustrated embodiment, the primary and secondary windings of the ignition coil IG each are grounded at one end thereof and the primary winding has a damper diode Di2 connected in parallel thereacross. The damper diode Di2 has a cathode arranged so as to face the ground. The ignition capacitor Ci is connected at one end thereof to a non-grounded terminal of the primary winding of the ignition coil and at the other end thereof through the diode Di1 to one end of the exciter coil W1. The diode Di1 has a cathode arranged so as to face the capacitor Ci. The thyristor Thi is connected between the other end of the capacitor Ci and the ground while keeping a cathode thereof facing capacitor Ci. The secondary winding of the ignition coil IG has a non-grounded terminal connected through a high-tension cord to a non-grounded terminal of an ignition plug P mounted on a cylinder of the internal combustion engine.

Also, the illustrated embodiment includes a power capacitor C3 having a highly increased electrostatic capacity which is arranged in place of a battery between output terminals of a second power circuit 33, so that the capacitor C3 may be charged by means of a second DC voltage E2 provided by the second power circuit 33.

A control unit 36 is constructed so as to generate an injection command signal Sj fed to a drive current control switch 30 and a drive signal Son fed to a charge voltage control switch 34 and generate an ignition signal Si for determining an ignition timing of the internal combustion engine. The ignition signal Si is fed to a gate of the thyristor Thi of the ignition device 40. The remaining part of the illustrated embodiment may be constructed in substantially the same manner as the embodiment described above with reference to FIG. 1.

In the embodiment shown in FIG. 3, the output voltage of one half cycle of the first generating coil or exciter coil W1 permits a current to flow through the diode Di1, ignition capacitor Ci, diode Di2 and current feedback diode D3 of the ignition device 40, resulting in the ignition capacitor being charged at polarities shown in FIG. 3. Then, when the control unit 36 feeds the thyristor Thi with the ignition signal Si at the ignition timing of the internal combustion engine, the thyristor Thi is turned on, so that charges in the ignition capacitor Ci are discharged through the thyristor Thi and the primary winding of the ignition coil IG. This permits a voltage at an increased level to be induced across the primary winding of the ignition coil IG, which is further increased, resulting in a voltage at an increased level for ignition being induced across the secondary winding of the-ignition coil. The voltage for ignition thus increased is then applied to the ignition plug P, so that spark discharge may occur at the ignition plug, leading to ignition of the internal combustion engine.

Also, generation of the output voltage of the other half cycle from the first generating coil W1 permits a current to flow through a path extending from the first generating coil W1 through the rectification element in the first power circuit 32, the first capacitor C1, the grounded circuit D2 to the generating coil W1, so that the first capacitor C1 may be charged to a predetermined voltage level.

Also, the capacitor C3 is charged by means of the output voltage of the second power circuit 33, so that a holding current may be fed through the diode D1 to the solenoid coil 3*a* of the injector 1 by means of charges accumulated in the capacitor C3. The remaining part of the operation may be carried out in substantially the same way as in the embodiment of FIG. 1.

Figure 4:
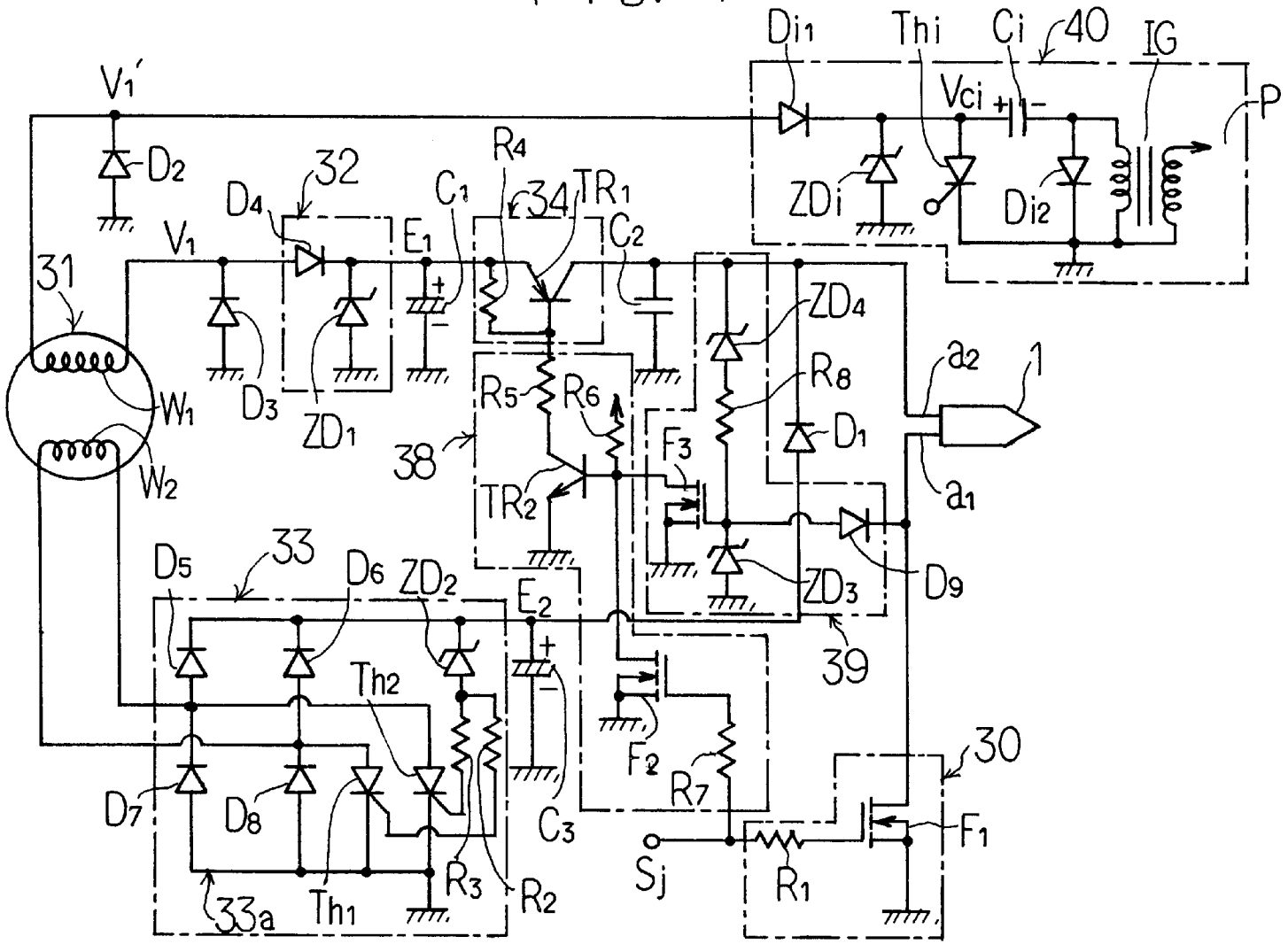
FIG. 4 is a circuit diagram showing a further embodiment of an injector drive circuit according to the present invention.

Referring now to FIG. 4, a further embodiment of an injector drive circuit according to the present invention is illustrated. In the illustrated embodiment, a charge control switch drive circuit 38 is arranged so as to detect falling of an injection command signal to feed a charge control switch 34 with a drive signal rather than feeding of a drive signal from a control unit to the charge control switch 34. Also, in the illustrated embodiment, a charge control circuit 39 is arranged so as to restrict a charging voltage of a second capacitor C2 to a predetermined level or below.

In FIG. 4, a magneto 31 may be constructed in substantially the same manner as that in the embodiment described above with reference to FIG. 3. More particularly, a first generating coil W1 is constituted by an excitor coil arranged for driving an ignition device 40 of the capacitor discharge type for an internal combustion engine. The first generating coil W1 is connected at one end thereof to a cathode of a diode D2 of which an anode is grounded, as well as to a power input terminal of the ignition device 40 or an anode of a diode Di1. Also, the first generating coil W1 is connected at the other end thereof to a cathode of a diode D3 of which an anode is grounded, as well as to an input terminal of a first power circuit 32.

The ignition device 40 may be constructed in substantially the same manner as that in the embodiment shown in FIG. 3, except that a Zener diode ZDi is connected in parallel across a thyristor Thi so as to restrain a voltage of an ignition capacitor Ci from being excessively increased.

A drive current control switch 30 includes an FET F1 which has a source grounded and a drain connected to a first power terminal a1 of an injector 1 and a resistor R1 connected at one end thereof to a gate of the FET and at the other end thereof to an injection command signal output terminal of a control unit (now shown).

The first power circuit 32 includes a diode D4 having an anode connected to the other end of the first generating coil W1 and a Zener diode ZD1 connected between a cathode of the diode D4 and the ground while keeping an anode thereof facing the ground and is constructed so as to generate a first DC voltage E1 across the Zener diode ZD1. The first DC voltage E1 is applied across a first capacitor Ci.

A second power circuit 33 includes a full-wave rectification circuit 33*a* provided by subjecting diodes D5 to D8 to bridge connection, thyristors Th1 and Th2 of which anodes are respectively connected to a pair of AC input terminals of the rectification circuit 33*a* and cathodes each are connected to a negative polarity-side output terminal of the full-wave rectification circuit 33*a* and grounded, resistors R2 and R3 which are respectively connected at one end thereof to gates of the thyristors Th1 and Th2 and at the other end to each other, and a Zener diode ZD2 connected between a common connection of the resistors R2 and R3 and a positive polarity-side output terminal of the rectification circuit 33*a*. An output voltage of the full-wave rectification circuit 33*a* is applied to a capacitor C3.

The second power circuit 33 is so constructed that the rectification circuit 33*a* rectifies an output voltage of a second generating coil W2 to convert it into a second DC voltage E2. When the second DC voltage E2 exceeds a predetermined level, the Zener diode ZD2 is turned on, so that a current may be fed from the positive polarity-side output terminal of the rectification circuit 33*a* through the Zener diode ZD2 and resistors R2 and R3 to the gates of the thyristors Th1 and Th2. This permits the thyristors Th1 and Th2 to be turned on, so that the second-, generating coil W2 is short-circuited through a path extending from the second generating coil W2 through the thyristor Th2 to the diode D8 or a path extending from the second generating coil W2 through the thyristor Th2 to the diode D8, resulting in charging of the capacitor C3 being interrupted. This permits a voltage across the capacitor C3 or the second DC voltage E2 to be kept at a predetermined level or below. The voltage across the capacitor C3 is applied through the diode D1 across a series circuit of a solenoid coil of an injector 1 and the switch 30.

The charge control switch 34 arranged between the first capacitor C1 and the second capacitor C2 includes a PNP transistor TR1 having an emitter connected to a positive polarity-side terminal or non-grounded terminal of the first capacitor C1 and a resistor R4 connected between the emitter of the transistor TR1 and a base thereof. The transistor TR1 has a collector connected to a non-grounded terminal of the second capacitor C2.

The charge control switch drive circuit 38 includes an NPN transistor TR2 which is grounded at an emitter thereof and connected at a collector thereof through a resistor R5 to the base of the transistor TR1, a resistor R6 connected between a base of the transistor TR2 and a positive polarity terminal of a power circuit (not shown), an FET F2 having a drain connected to the base of the transistor TR2 and a source grounded, and a resistor R7 connected between a gate of the FET F2 and an input terminal of the drive current control switch 30.

In the charge control switch drive circuit 38 thus constructed, the FET F2 is kept turned on while it is fed with an injection command signal Sj, so that the transistor TR2 may be kept turned off. When the transistor TR2 is kept turned off, a current is kept from being fed to the base of the transistor TR1, so that the transistor TR1 constituting the charge control switch 34 may be kept turned off. When the injection command signal Sj falls to a zero level, the FET F2 is turned off, so that the transistor TR2 is turned on to permit a current to be fed to the base of the transistor TR1, resulting in the transistor TR1 being turned on.

In the charge control switch drive circuit 38 shown-in FIG. 4, the FET F2 and resistor R7 cooperate with each other to constitute an injection command signal falling detection circuit for detecting falling of the injection command signal Sj. Also, the resistors R5 and R6 and transistor TR2 cooperate with each other to constitute a drive signal feed circuit for feeding the charge control switch 34 with a drive signal when the injection command signal falling detection circuit detects falling of the injection command signal.

The charge control circuit 39 includes an FET F3 having a drain connected to the base of the transistor TR2, a Zener diode ZD3 connected between a gate of the FET F3 and the ground while keeping an anode thereof facing the ground, a resistor R8 connected at one end thereof to the gate of the FET F3, a Zener diode ZD4 connected between the other end of the resistor R8 and the non-grounded terminal of the second capacitor C2 while keeping an anode thereof facing the resistor R8, and a diode D9 connected between the gate of the FET F3 and a drain of the FET F1 constituting the drive current control switch 30 while keeping an anode thereof facing the FET F3.

In the charge control circuit 39 thus constructed, when a voltage across the second capacitor C2 is at a predetermined level or below, the Zener diode ZD4 is kept turned off, resulting in the FET F3 being kept turned off. At this time, the FET F3 does not affect operation of the transistor TR2, so that the charge control switch drive circuit 38 feeds a current to the base of the transistor TR1 when the injection command signal Sj falls to a zero level. This permits the transistor TR1 to be turned on, to thereby prevent a current from being fed to the base of the transistor TR1 when the injection command signal Sj is generated, resulting in the transistor TR1 being turned off.

On the contrary, when the voltage across the second capacitor C2 exceeds the predetermined level, the Zener diode ZD4 is turned on, so that the FET F3 is turned on. In such a state, the transistor TR2 is forcibly rendered turned off, so that the transistor TR1 is turned off, to thereby interrupt transfer of charges from the first capacitor C1 to the second capacitor C2. This holds the voltage across the second capacitor C2 at a fixed level or below.

Also, when the injection command signal Sj is generated to turn on the FET F1, a potential at gate of the FET F3 is reduced through the diode D9 and FET F1, so that the FET F3 may be kept turned off.

Figures 5A, 5B, 5C, 5D, 5E, 5F:
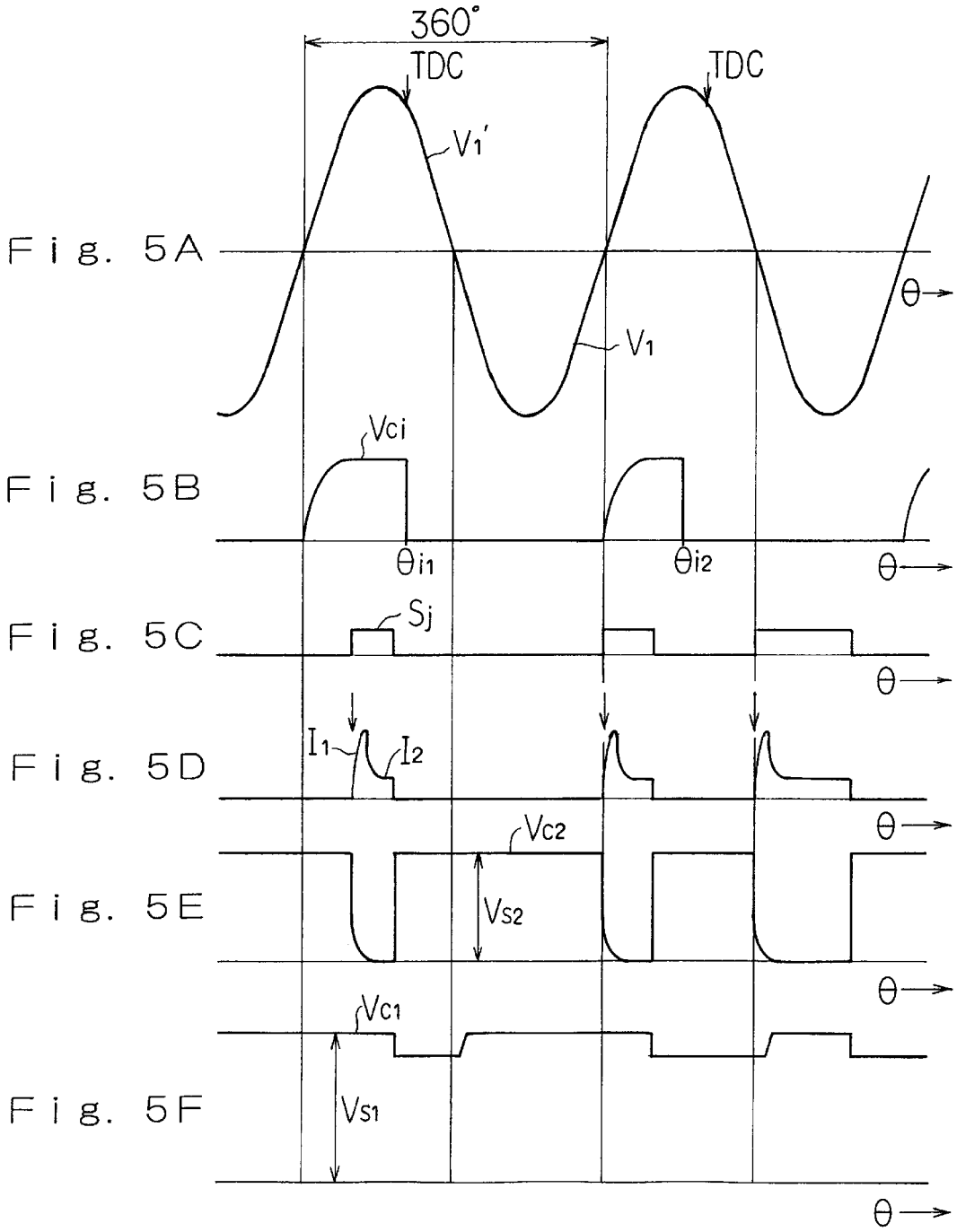
FIGS. 5A to 5F each are a waveform chart showing a waveform of each of a voltage and a current at each of portions of the injector drive circuit shown in FIG. 4.

In the embodiment shown in FIG. 4, the first generating coil W1 generates an AC voltage having such a waveform as shown in FIG. 5A with respect to an angle θ of a crank shaft of an internal combustion engine. The waveform shown in FIG. 5A is of an AC voltage outputted from the first generating coil W1 during non-load. The ignition capacitor Ci of the ignition device 40 is charged by means of a voltage V1' of a positive half cycle outputted from the AC voltage thus generated, so that a voltage Vci across the ignition capacitor Ci is increased as shown in FIG. 5B. When the control unit (not shown) feeds the thyristor Thi with an ignition signal at ignition timings θi1, θi2, . . . of the internal combustion engine, the thyristor Thi is turned on, resulting in the voltage across the capacitor Ci being reduced to a zero level.

In addition, a voltage of a negative half cycle outputted from the first generating coil W1 permits the first capacitor C1 to be charged to a predetermined level Vs1 (a Zener voltage of the Zener diode ZD1). FIG. 5F shows a waveform of the voltage Vc1 across the first capacitor C1. The capacitor C1 is charged when the voltage of a negative half cycle generated from the first generating coil W1 exceeds the voltage across the capacitor C1. Thus, the voltage Vc1 across the first capacitor C1 has a waveform increased to the predetermined level Vs1 from a position delayed on the basis of a position at which the first generating coil W1 generates the voltage of the negative half cycle.

When the injection command signal Sj is generated as shown in FIG. 5C, the FET F1 is turned on, so that a starting current I1 is permitted to flow from the first capacitor C1 through the solenoid coil of the injector 1 as shown in FIG. 5D. This leads to discharge of the second capacitor C2, so that a voltage Vc2 across the second capacitor C2 may be reduced. When the voltage across the second: capacitor C2 is reduced to a level below an output voltage of the second power circuit 33, the diode D1 is forwardly biased, so that a holding current I2 may be fed from the second power circuit 33 through the diode D1 to the solenoid coil of the injector 1 as shown in FIG. 5D. When the injection command signal Sj falls to a zero level, the transistor TR1 is turned on by such operation as described above, so that charges in the first capacitor C1 are transferred to the second capacitor C2, resulting in the voltage across the second capacitor C2 being increased. When the voltage across the second capacitor C2 reaches a predetermined level, the FET F3 is turned on, so that the transistors TR2 and TR1 are turned on, resulting in charging of the second capacitor C2 being interrupted. Thus, the voltage across the second capacitor C2 is kept at an interval set level Vs2 at which the injection command signal Sj is kept from being generated, as shown in FIG. 5E. The set level Vs2 is set to be much higher than a level of a voltage required to be applied to the solenoid coil of the injector 1 in order to permit a starting current equal to or above the starting current Io to be fed to the solenoid coil. Also, a set level Vs1 of the charging voltage Vc1 of the first capacitor C1 is set so as to permit the second capacitor C2 to be repeatedly charged to a set level Vs2 at least at times equal to the number of cylinders of the internal combustion engine.

The embodiments described above each are applied to direct injection of fuel into a cylinder of a single-cylinder internal combustion engine. It is a manner of course that the present invention may be applied to driving of an injector for injecting fuel into cylinders of a multi-cylinder internal combustion engine. An injector drive circuit which is directed to driving of an injector for injecting fuel into each of cylinders of a multi-cylinder internal combustion engine is basically constructed in substantially the same manner as the injector drive circuit for driving an injector for directly injecting fuel into a cylinder of a single-cylinder internal combustion. However, in order to drive an injector for a multi-cylinder internal combustion engine, the present invention may be practiced either in a manner to commonly arrange a second capacitor C2 for a plurality of cylinders or in a manner to arrange a second capacitor for each of cylinders.

Figure 6:
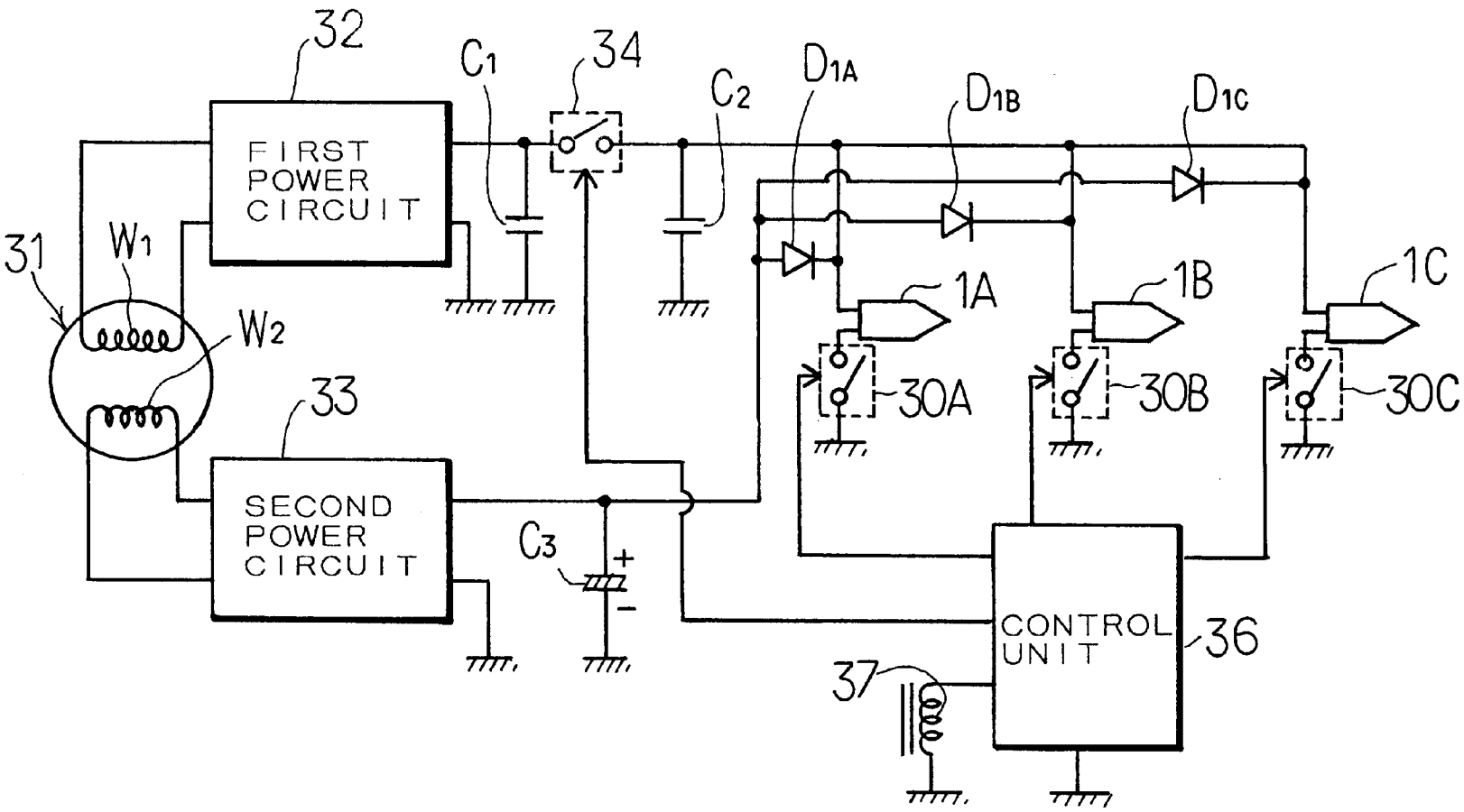
FIG. 6 is a circuit diagram showing still another embodiment of an injector drive circuit according to the present invention, which is adapted to drive injectors mounted on a multi-cylinder internal combustion engine for injection of fuel into cylinders.

Referring now to FIG. 6, still another embodiment of an injector drive circuit according to the present invention is illustrated, which is adapted to drive injectors for directly injecting fuel to three cylinders of a three-cylinder internal combustion engine. In FIG. 6, reference characters 1A, 1B and 1C designate first, second and third injectors mounted on first, second and third cylinders of a three-cylinder internal combustion engine, respectively. The first to third injectors 1A to 1C include respective solenoid coils which are grounded at one end thereof through drive current control switches 30A to 30C, respectively. Series circuits respectively constituted by the solenoid coils of the injectors 1A to 1C and the switches 30A to 30C are connected in parallel to each other.

In the illustrated embodiment, a second capacitor C2 is arranged in a manner to be common to the first to third injectors 1A to 1C, so that a voltage across the second capacitor C2 may be applied to the solenoid coils of the injectors 1A to 1C through the drive current control switches 30A to 30C, respectively.

Also, first to third holding current feed diodes D1A to D1C are arranged in correspondence to the first to third cylinders of the internal combustion engine, respectively, so that an output voltage of a second power circuit 33 through the first to third holding current feed diodes D1A to D1C across the series circuits constituted by the solenoid coils of the injectors 1A to 1C mounted on the first to third cylinders and the drive current control switches 30A to 30C, respectively.

Also, the illustrated embodiment is constructed in such a manner that a control unit 36 feeds a charge control switch 34 with a drive signal to keep the charge control switch turned on during a period of time for which all injection command signals fed to the injectors 1A to 1C mounted on the first to third cylinders of the internal combustion engine are extinguished. The remaining part of the illustrated embodiment may be constructed in substantially the same manner as the embodiment described above with reference to FIG. 1. A timing at which the charge control switch 34 is turned on may be selected as desired within a period for which all the injection command signals fed to the injectors 1A to 1C mounted on the first to third cylinders are extinguished.

As shown in FIG. 6, arrangement of the second capacitor C2 in a manner to be common to the multiple cylinders permits the injector drive circuit to be simplified in structure because only one such second capacitor C2 is merely required.

In the injector drive circuit shown in FIG. 6, it is required that fuel injection periods of the respective cylinders are kept from overlapping each other. Overlapping of the fuel injection periods fails to permit a sufficient starting current to be fed to the solenoid coils of the injectors mounted on the cylinders of which fuel injection periods overlap each other, leading to any possible failure in fuel injection. In order to avoid such a problem, it is required to arrange a plurality of second capacitors in correspondence to the plural cylinders.

Figure 7:
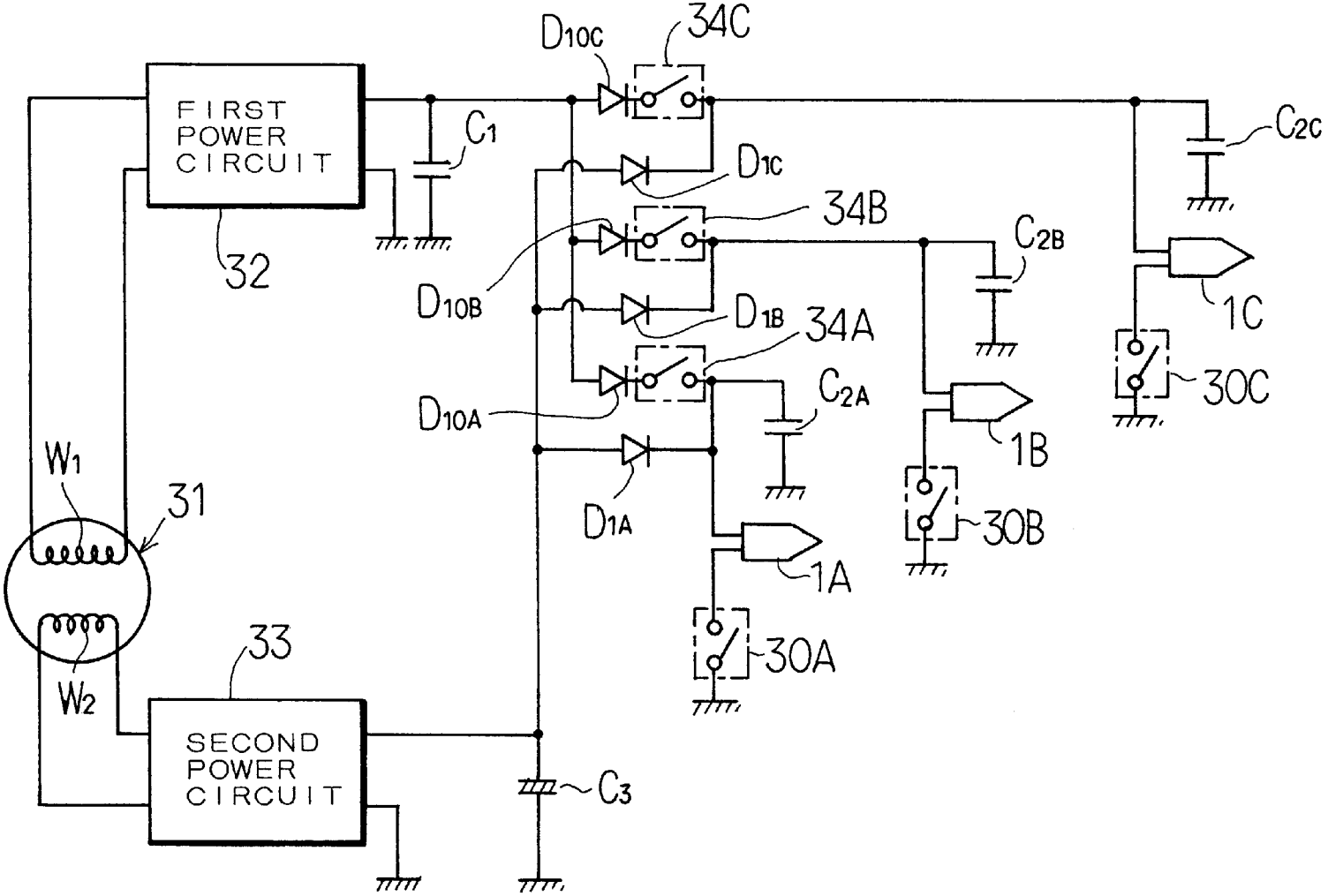
FIG. 7 is a circuit diagram showing yet another embodiment of an injector drive circuit according to the present invention, which is adapted to drive injectors mounted on a multi-cylinder internal combustion engine for injection of fuel into cylinders.

Referring now to FIG. 7, a still further embodiment of an injector drive circuit according to the present invention is illustrated, which is constructed so as to drive an injector for injecting fuel directly into cylinders of a three-cylinder internal combustion engine. More specifically, three second capacitors C2A to C2C are individually arranged with respect to the three cylinders of the internal combustion engine, respectively, so that a voltage across the first capacitor C1 may be applied across the second capacitors C2A to C2C through first to third check diodes D10A to D10C respectively arranged with respect to the first to third cylinders and through charge control switches 34A to 34C, respectively. Also, voltages across the second capacitors C2A to C2C arranged with respect to the first to third cylinders are applied across series circuits constituted by solenoid coils of first to third injectors 1A to 1C arranged with respect to the first to third cylinders and drive current control switches 30A to 30C.

The injector drive circuit of the illustrated embodiment also includes a capacitor C3, which is connected across the second power circuit 33, so that a voltage across the capacitor C3 is applied across the series circuits constituted by the solenoid coils of the first to third injectors 1A to 1C and the drive current control switches 30A to 30C through holding current feed diodes D1A to D1C respectively arranged with respect to the first to third cylinders. The charge control switches 34A to 34C are fed with a drive signal from a control unit (not shown), to thereby be turned on during a period of time for which injection command signals fed to the injectors of the cylinders corresponding to the switches 34*a* to 34C are extinguished. The remaining part of the illustrated embodiment may be constructed in substantially the same manner as the embodiment of FIG. 1. Timings at which the charge control switches 34A to 34C are turned on may be selected as desired within a period for which all the injection command signals fed to the injectors 1A to 1C corresponding thereto are extinguished.

In the illustrated embodiment, as described above, the second capacitors and charge control switches are individually arranged with respect to the plural cylinders of the internal combustion engine, so that the voltage across the first capacitor is applied across the second capacitors corresponding to the cylinders through the charge control switches corresponding thereto. Also, the charge control switches corresponding to the cylinders are turned on during a period of time for which the injection command signals fed to the injectors are extinguished. Such construction, even when fuel injection timings of the cylinders overlap each other, permits a starting current of a highly increased magnitude to be fed to the solenoid coils of the injectors corresponding thereto, so that valve opening operation of the injectors may be ensured.

In each of the embodiments described above, the output voltage of the first power circuit 32 is accumulated in the first capacitor C1. Alternatively, the capacitor C1 may be replaced with any other suitable voltage accumulation means such as, for example, a high-voltage battery.

As can be seen form the foregoing, in the present invention, an AC voltage generated from the magneto driven by the internal combustion engine is converted into a DC voltage and then accumulated in the voltage accumulation means, so that the capacitor is charged by means of the voltage accumulated in the voltage accumulation means during a period of time for which the injection command signal is not generated and a voltage across the capacitor is applied to the injector when it is fed with the injection command signal, to thereby feed a drive current to the injector. Such construction permits the injector to be driven at any rotation angle position of the engine as in use of a DC-DC converter while using an AC voltage outputted from the magneto as a power voltage and irrespective of a phase of the AC voltage. Thus, the present invention permits the injector to be driven at any rotation angle position of the internal combustion engine, without any limitation, as in use of a DC-DC converter while eliminating use of such an expensive DC-DC converter.

Also, in the present invention, when the first power circuit is constructed so as to output a first DC voltage required to provide a drive current of a predetermined level using a voltage of a half cycle generated from the exciter coil for driving the internal combustion engine as a power voltage, the injector may be driven utilizing any coil inherently arranged in the magneto.

Further, the present invention may be so constructed that an output voltage of the second power circuit is applied across the series circuit of the solenoid coil and drive current control switch through the holding current feed diode forward to the driving current. Such construction, when a voltage across the second capacitor is higher than the output voltage of the second power circuit, reversely biases the diode to feed a starting current from the second capacitor to the solenoid coil. Also, the construction, when the second capacitor discharges to reduce a voltage thereacross to a level below the output voltage of the second power circuit, forwardly biases the diode to feed a holding current from the second power circuit to the solenoid coil. Thus, the present invention permits change-over between the starting current and the holding current to be automatically carried out without any switch circuit of which control is required.

Moreover, the present invention may include the circuit arranged so as to control charging of the second capacitor. In such arrangement, when an electrostatic capacity of the first capacitor is highly increased as compared with that of the second capacitor and a charging voltage of the first capacitor is set to be at a level much higher than that of the second capacitor, a voltage across the first capacitor once charged may be used to repeatedly charge the second capacitor to a set voltage many times. Thus, when an injector is individually arranged for every cylinder of a multi-cylinder internal combustion engine, only one such first capacitor is merely required in order to feed a starting current of a sufficient magnitude to all the injectors.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. An injector drive circuit for driving, in response to an injection command signal having a time width corresponding to fuel injection time, an injector which includes a valve for operating an injection port and a solenoid coil for driving the valve and is constructed so as to open the valve to inject fuel into a fuel injection space of an internal combustion engine when the solenoid coil is fed with a predetermined drive current, comprising:

a power circuit for outputting a first DC voltage having a level equal to or above a level of a drive voltage required to be applied to said solenoid coil when said valve is rendered open while using a magneto driven by said internal combustion engine as a power supply therefor;

a voltage accumulation means for accumulating said first DC voltage therein;

a capacitor charged by means of the voltage accumulated in said voltage accumulation means during a period of time for which said injection command signal is kept from being generated;

a drive current feed circuit for applying a voltage across said capacitor to said solenoid coil to feed the drive current to said solenoid coil when it is fed with said injection command signal; and a holding current feed power supply section for feeding said solenoid coil with a holding current required to keep said valve open after the drive current fed from said capacitor to said solenoid coil passes a peak value.

2. An injector drive circuit for driving, in response to an injection command signal having a time width corresponding to fuel injection time, an injector which includes a valve for operating an injection port and a solenoid coil for driving the valve and is constructed so as to open the valve to inject fuel into a fuel injection space of an internal combustion engine when the solenoid coil is fed with a predetermined drive current, comprising:

a first power circuit for outputting a first DC voltage having a level equal to or above a level of a drive voltage required to be applied to said solenoid coil when said valve is rendered open while using a magneto driven by said internal, combustion engine as a power supply therefor;

a second power circuit for outputting a second DC voltage of a level required to be applied to said solenoid coil in order to permit a holding current required for holding said valve open to be fed to said solenoid coil while using said magneto as a power supply therefor;

a first capacitor charged by means of said first DC voltage;

a charge control switch rendered turned on during a period of time for which said injection command signal is extinguished;

a second capacitor charged through said charge control switch by means of a voltage across said first capacitor;

a drive current control switch connected in series to said solenoid coil and turned on in response to said injection command signal; and a holding current feed diode forward with respect to said holding current and connected between a series circuit of said solenoid coil and drive current control switch and said second power circuit;

said series circuit of said solenoid coil and drive current control switch having a voltage across said second capacitor applied thereacross;

said series circuit of said solenoid coil and drive current control switch having an output voltage of said second power circuit applied thereacross through said holding current feed diode.

3. An injector drive circuit as defined in claim 2, further comprising a charge control circuit for interrupting charging of said second capacitor when the voltage across said second capacitor reaches a predetermined level.

4. An injector drive circuit for driving, in response to an injection command signal having a time width corresponding to fuel injection time, an injector which includes a valve for operating an injection port and a solenoid coil for driving the valve and is constructed so as to open the valve to inject fuel into a fuel injection space of an internal combustion engine when the solenoid coil is fed with a predetermined drive current, comprising:

a first power circuit for outputting a first DC voltage having a level equal to or above a level of a drive voltage required to be applied to said solenoid coil when said valve is rendered open while using a voltage of one half cycle generated from an excitor coil arranged in a magneto driven by said internal combustion engine as a power voltage and using a voltage of the other half cycle generated from said excitor coil for driving an ignition device for said internal combustion engine;

a second power circuit for outputting a second DC voltage of a level required to be applied to said solenoid coil in order to permit a holding current required for holding said valve open to be fed to said solenoid coil while acting a generating coil arranged separately from said exciter coil in said magneto as a power supply therefor;

a first capacitor charged by means of said first DC voltage;

a charge control switch rendered turned on during a period of time for which said injection command signal is extinguished;

a second capacitor charged through said charge control switch by means of a voltage across said first capacitor;

a drive current control switch connected in series to said solenoid coil and turned on in response to said injection command signal; and a holding current feed diode forward with respect to said holding current and connected between a series circuit of said solenoid coil and drive current control switch and said second power circuit;

said series circuit of said solenoid coil and drive current control switch having a voltage across said second capacitor applied thereacross;

said series circuit of said solenoid coil and drive current control switch having an output voltage of said second power circuit applied thereacross through said holding current feed diode.

5. An injector drive circuit as defined in claim 4, further comprising a charge control circuit for interrupting charging of said second capacitor when the voltage across said second capacitor reaches a predetermined level.

6. An injector drive circuit for driving, in response to an injection command signal having a time width corresponding to fuel injection time, a plurality of injectors each including a valve for operating an injection port and a solenoid coil for driving the valve and constructed so as to open the valve to inject fuel into a combustion chamber of each of a plurality of cylinders of a multi-cylinder internal combustion engine when the solenoid coil is fed with a predetermined drive current, comprising:

a first power circuit for outputting a first DC voltage having a level equal to or above a level of a drive voltage required to be applied to said solenoid coil of each of said injectors when said valve of each of said injectors is rendered open while using a magneto driven by said internal combustion engine as a power supply therefor;

a second power circuit for outputting a second DC voltage required to be applied to said solenoid coil of each of said injectors in order to permit a holding current required for holding said valve of each of said injectors open to be fed to said solenoid coil while using said magneto as a power supply therefor;

a first capacitor charged by means of said first DC voltage;

a charge control switch rendered turned on during a period of time for which all of said injection command signals fed to said injectors mounted on said cylinders are extinguished;

a second capacitor arranged in a manner to be common to said cylinders of said internal combustion engine and charged through said charge control switch by means of a voltage across said first capacitor;

a plurality of drive current control switches connected in series to said solenoid coils of said injectors, respectively; and a holding current feed diode arranged with respect to each of said cylinders of said multi-cylinder internal combustion engine;

series circuits each constituted by said solenoid coil of said injector arranged for each of said cylinders of said multicylinder internal combustion engine and each of said drive current control switches;

said series circuits each having a voltage across said second capacitor applied thereacross;

said series circuits each having an output voltage of said second power circuit applied thereacross through said holding current feed diode.

7. An injector drive circuit as defined in claim 6, further comprising a charge control circuit for interrupting charging of said second capacitor when the voltage across said second capacitor reaches a predetermined level.

8. An injector drive circuit for driving, in response to an injection command signal having a time width corresponding to fuel injection time, a plurality of injectors each including a valve for operating an injection port and a solenoid coil for driving the valve and constructed so as to open the valve to inject fuel into a combustion chamber of each of a plurality of cylinders of a multi-cylinder internal combustion engine when the solenoid coil is fed with a predetermined drive current, comprising:

a first power circuit for outputting a first DC voltage having a level equal to or above a level of a drive voltage required to be applied to said solenoid coil of each of said injectors when said valve of each of said injectors is rendered open while using a magneto driven by said internal combustion engine as a power supply therefor;

a second power circuit for outputting a second DC voltage required to be applied to said solenoid coil of each of said injectors in order to permit a holding current required for holding said valve of each of said injectors open to be fed to said solenoid coil while using said magneto as a power supply therefor;

a first capacitor charged by means of said first DC voltage;

a charge control switch arranged for each of said cylinders and rendered turned on when said injection command signal fed to said injector mounted on each of said cylinders is extinguished;

a second capacitor arranged for each of said cylinders and charged through a check diode arranged for each of said cylinders and said charge control switch for each of said cylinders by means of a voltage across said capacitor;

a drive current control switch for each of said cylinders connected in series to said solenoid coil of said injector of each of said cylinders; and series circuits each constituted by said solenoid coil of said injector arranged for each of said cylinders of said cylinder internal combustion engine and said drive current control switch for each of said cylinders;

said series circuits each having a voltage across said second capacitor for each of said cylinders applied thereacross;

said series circuits each having an output voltage of said second power circuit applied thereacross through a holding current feed diode arranged for each of said cylinders.

9. An injector drive circuit as defined in claim 8, further comprising a charge control circuit for interrupting charging of said second capacitor when the voltage across said second capacitor reaches a predetermined level.

* * * * *

UNITED STATES PATENT AND TRADEMARK OFFICE

CERTIFICATE OF CORRECTION

PATENT NO. : 6,123,058

DATED : September 26, 2000

INVENTOR(S) : Endou

It is certified that error appears in the above-indentified patent and that said Letters Patent is hereby corrected as shown below:

On the title page, Section [73], Assignee:, delete "Shizuoak-Ken" and insert --Shizuoka-Ken--.

Column 5, Line 17, delete "coil:" and insert --coil--.

Column 7, Line 8, delete "closing:" and insert --closing--.

Column 9, Line 1, delete "equal-to" and insert --equal to--.

Column 11, Lines 63-64, delete "open:position" and insert --open position--.

Column 14, Line 10, delete "Cl" and insert --Ci--.

Column 14, Line 64, delete "the-ignition" and insert --the ignition--.

Column 15, Line 56, delete "Ci" and insert --Cl--.

UNITED STATES PATENT AND TRADEMARK OFFICE

CERTIFICATE OF CORRECTION

PATENT NO. : 6,123,058

DATED : September 26, 2000

INVENTOR(S) : Endou

It is certified that error appears in the above-indentified patent and that said Letters Patent is hereby corrected as shown below:

Column 16, Line 13, delete "second-," and insert --second,--.

Column 16, Line 54, delete "shown-in" and insert --shown in--.

Column 17, Line 66, delete "second:" and insert --second--.

Column 21, Line 61 (Claim 2), delete "internal," and insert --internal--.

Column 23, Line 28 (Claim 6), delete "multicylinder" and insert --multi-cylinder--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*